United States Patent [19]

Itakura et al.

[11] Patent Number: 5,067,368

[45] Date of Patent: Nov. 26, 1991

[54] PEDAL MECHANISM FOR SEWING MACHINE DRIVE DEVICE

[75] Inventors: Tadakatsu Itakura; Tatsuya Sawato, both of Aichi, Japan

[73] Assignee: Mitsubishi Denki K.K., Tokyo, Japan

[21] Appl. No.: 449,217

[22] Filed: Dec. 11, 1989

[30] Foreign Application Priority Data

Dec. 24, 1988 [JP] Japan ..... 63-326720

[51] Int. Cl.[5] ..... G05G 1/14; D05B 69/14

[52] U.S. Cl. ..... 74/560; 74/561; 74/512; 112/271

[58] Field of Search ..... 74/560, 512, 561, 514; 112/217-217.4

[56] References Cited

U.S. PATENT DOCUMENTS 469,426 2/1892 Rouse ..... 74/561
3,327,662 6/1967 Abate et al. ..... 112/217.3

FOREIGN PATENT DOCUMENTS 61-1893 1/1986 Japan .
1-293898 5/1988 Japan ..... 112/217.4
63-49270 12/1988 Japan .
0166220 4/1955 Sweden ..... 112/217.3

*Primary Examiner*—Allan D. Herrmann
*Assistant Examiner*—Winnie Yip
*Attorney, Agent, or Firm*—Sughrue, Mion, Zinn Macpeak & Seas

[57] ABSTRACT

A pedal mechanism for a sewing machine drive device, comprising: a support member fixedly mounted on a support plate extending horizontally between legs of a sewing machine table; a pedal mounting base mounted adjacent to the support plate, a foot-operated pedal being mounted on the pedal mounting base, the pedal transmitting an operation signal to a sewing machine controller when the pedal is pressed down; and an articulated linkage mechanism for connecting the support member and the pedal mounting base in such a manner that the linkage mechanism can be angulaly moved so as to move the pedal mounting base between an operating position and a non-operating position while maintaining the base in a horizontal condition, so that the pedal mounting base can be placed on the support plate.

10 Claims, 5 Drawing Sheets

PEDAL MECHANISM FOR SEWING MACHINE DRIVE DEVICE

BACKGROUND OF THE INVENTION

1. Field of the Invention

This invention relates to an improved pedal mechanism for used in a sewing machine drive device.

2. Prior Art

FIGS. 7 to 9 shows a conventional device of this general type as disclosed in Japanese Laid-Open (Kokai) Utility Model Application No. 10188/86. A support plate 2 of a U-shaped cross-section horizontally extends between and supported by legs (not shown), and is spaced apart from the floor 1. A lever unit 30 outputs a variable-speed running instruction. A connecting wire 31 connects the lever unit 30 to a controller (not shown). Reference numeral 32 denotes a lever, and a unit casing 34 has a projection 35. The lever unit 30 is mounted on a mounting plate 36 which is fastened to the support plate 2 by bolts 38. Each support plate 42 is mounted on the mounting plate 36 by a hinge 44. A pedal mounting base 46 is fixedly connected to the support plate 42 by bolts 48. The pedal mounting base 46 has slots 49 extending generally vertically, and the bolts 48 extend through the slots 49, respectively, so that the height of the pedal base plate 46 above the floor 1 can be adjusted.

A speed pedal 51 and a switch pedal 52 both of which are of the foot-operated type are mounted on the pedal mounting base 46 by respective hinges 54. The two pedals 51 and 52 are disposed in juxtaposed relation and are slanting upwardly away from the hinge 54. A movable end of the speed pedal 51 is connected to the lever 32 through a connecting rod 56. Reference numeral 57 denotes a foot switch. The switch pedal 52 has a bent portion 58 at its distal end, and the bent portion 58 is disposed at a position corresponding to the projection 35 formed on the unit casing 34.

In order to enhance the productivity, the pedal mechanism of this type is operated by the operator who keeps standing during the operation. For this reason, the pedals are arranged in contact with the floor, and the sewing machine table is moved through casters to be set in a desired position in the sewing line as occasion calls, and then is used at such a position. Therefore, when the sewing is finished or interrupted, the pedal mechanism is required to be spaced apart from the floor and be kept in such a floating condition in order to enable the sewing machine table to be moved along the sewing line.

In the above conventional pedal mechanism, when the switch pedal 52 is raised, the pedal mounting base 46 and the support plate 42 are angularly moved about the hinge 44 in a counterclockwise direction as indicated by an arrow in FIG. 9, and the bent portion 58 is hooked to the projection 35. In this condition, the support plates 42 and the pedal mounting base 46, together with the two pedal 51 and 52, are kept spaced apart from the floor 1 as indicated by a dot-and-dash line in FIGS. 8 and 9. After such preparations are done, the sewing machine table can be moved to be set in a desired position in the sewing line.

After the sewing machine table is set in the sewing line, the bent portion 58 is disengaged from the projection 35, and the pedal mounting base 46 and the associated members are returned to their positions indicated by solid lines in FIGS. 8 and 9. In this case, when there exists a space between the underside of the pedal mounting base 46 and the floor, or when the pedal mounting base 46 is too high, which would be caused to the rugged surface of the floor or for other reasons, the bolts 4B are loosened to adjust the pedal mounting base 46 to eliminate such space and the inclination of the pedal mounting base 46 along the length of the support plate 2. After this adjustment, the speed of the sewing machine as well as the start and stop of the operation of the drive device can be controlled by foot-operating the speed pedal 51 and the switch pedal 52.

With the above construction of the conventional pedal mechanism for a sewing machine drive device, each time the sewing machine table is installed, it is usually necessary to loosen the bolts 48 to adjust the pedal mounting base 46 in accordance with the height of the support plate 2 relative to the floor 1, so that the pedal mounting base 46 can be held in contact with the floor 1. Further, the pedal mounting base 46 as well as the associated members is retained at only one point by the projection 35. Moreover, this retaining position is disposed out of the center, and therefore it is possible that the balance of the weight is adversely lost so that the pedal mounting base 46 may slide over the floor 1 when the sewing machine table is moved. Particularly when the bent portion 58 becomes disengaged from the projection 35 due to the shaking of the moving sewing machine table, the pedal mounting base 46 may drop to impinge on the floor 1, which may result in damage of the pedal mounting base.

With respect to a complicated operation of such a device, Japanese Utility Model Publication No. 1893/86 has proposed the following construction in an attempt to deal with such problem. In this construction, a foot switch plate is angularly moved through a hinge so as to lean against a support plate extending between legs. With this construction, the pedal plate can be easily moved upward and downward; however, there still remains the problem that such retaining is rather unstable, so that with a slight impact during the movement of the table, the pedal plate may accidentally drop or move downward.

SUMMARY OF THE INVENTION

With the above deficiencies of the prior art in view, it is an object of this invention to provide a pedal mechanism for a sewing machine drive device which can be prepared, with one touch, to enable the installation and movement of the sewing machine, and can be kept in a stable condition even when a pedal mounting base is in its inoperative or retracted position, thus enhancing the reliability.

According to the present invention, there is provided a pedal mechanism for a sewing machine drive device, comprising:

(a) a pair of support members fixedly mounted on a support plate extending horizontally between legs of a sewing machine table, each of said support members having at least first and second connecting holes;

(b) a pedal mounting base having a forward portion, each of the opposite sides of said forward portion having at least third and fourth connecting holes, said pair of support members being disposed respectively on the opposite sides of said forward portion;

(c) a foot-operated pedal mounted on a rearward portion of said pedal mounting base through a hinge, and being slanting upwardly toward said forward portion of said base, said pedal transmitting an operation signal to a sewing machine controller when said pedal is pressed down; and (d) two pair of connecting plates, one of each pair of connecting plates connecting said first connecting hole in said support member to said third connecting hole in said pedal mounting base, the other connecting plate connecting said second connecting hole in said support member to said fourth connecting hole in said pedal mounting base, the distance between said first and third connecting holes being equal to the distance between said second and fourth connecting holes, said connecting plates being angularly movable respectively about the axes of said first and second connecting holes in said support members so as to move said pedal mounting base upward and downward.

By virtue of the provision of the connecting means (connecting plates) connecting the pedal mounting base to the support member, the pedal mounting base can be moved into its retracted position while maintaining the pedal mounting base in a horizontal condition (that is, in parallel relation to the floor).

DESCRIPTION OF THE PREFERRED EMBODIMENT OF THE INVENTION

Figure 1:
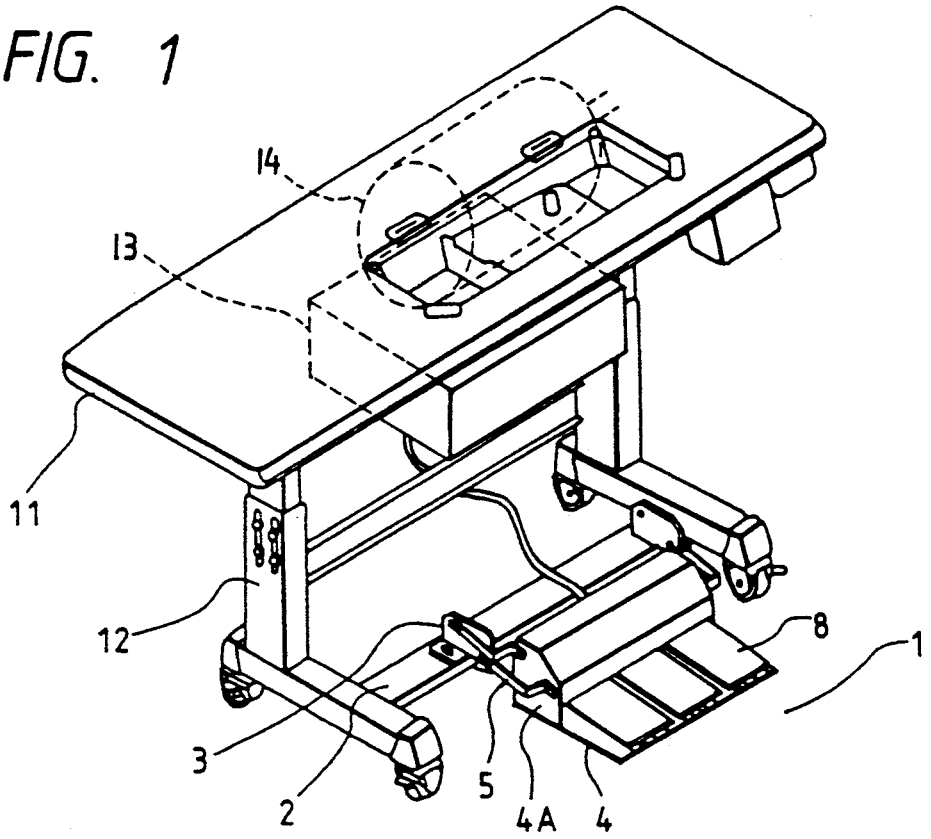
FIGS. 1 and 2 are perspective views of the overall construction of a sewing machine incorporating a pedal mechanism according to the present invention.

One preferred embodiment of the invention will now be described with reference to FIGS. 1 to 6. In the drawings, identical reference numerals denote identical or corresponding parts, respectively, and those parts already mentioned above will not be described further.

A pedal mechanism shown in FIGS. 1 to 6 will now be described. A sewing machine table 11 is placed on a floor 1. A pair of support members 3 are fixedly mounted by bolts 38 on a support plate 2 horizontally extending between legs 12 of the sewing machine table. The support members 3 are disposed adjacent to the side faces 4A (that is, the sides perpendicular to the support plate 2) of the pedal mounting base 4, respectively, and are spaced a predetermined distance from each other. The support member 3 has a first connecting hole **3*a* and a second connecting hole 3*b* spaced a predetermined distance from the first connecting hole 3*a*. A third connecting hole 4*b* and a fourth connecting hole 4*c* are formed in each of the side face 4A provided at the forward end portion of the pedal mounting base 4. The distance between the first connecting hole 3*a* and the third connecting hole 4*b* is equal to the distance between the second connecting hole 3*b* and the fourth connecting hole 4*c*. A pair of connecting plates 5 connect each support member 3 to the pedal mounting base 4. The connecting plate 5 has two connecting holes 5*a* formed respectively through its opposite ends and spaced a predetermined distance from each other. A bolt 6 passes through one connecting hole 5*a* of one connecting plate 5 and the first connecting hole 3*a* of the support member 3, and a bolt 6 passes through the other connecting hole 5*a* of the one connecting plate 5 and the third connecting hole 4*b* of the pedal mounting base 4. A bolt 6 passes through one connecting hole 5*a* of the other connecting plate 5 and the second connecting hole 3*b* of the support plate 3, and a bolt 6 passes through the other connecting hole 5*a* of the other connecting plate 5 and the fourth connecting hole 4*c* of the pedal mounting base 4. Nuts are threaded on these bolts 6, so that the connecting plates 5 are connected to the support member 3 and the pedal mounting base 4 so as to be angularly moved. A sensor unit 7 detects the pivotal movement of foot-operated pedals 8 about a hinge 9. The hinge 9 is located at the rearward end portion of the petal mounting base 4 and connects the foot-operated pedals 8 to the pedal mounting base 4. The foot-operated pedals 8 slant upward towards the forward end portion of the pedal mounting base 4. The sensor unit 7 is connected via a connecting wire to a sewing machine controller 13** for controlling the operation of the sewing machine, so that the sewing machine can be driven.

The operation of the above sewing machine drive device 14 is well known in the art, and will not be described here.

The operation of the pedal mechanism will now be described.

Figure 3:
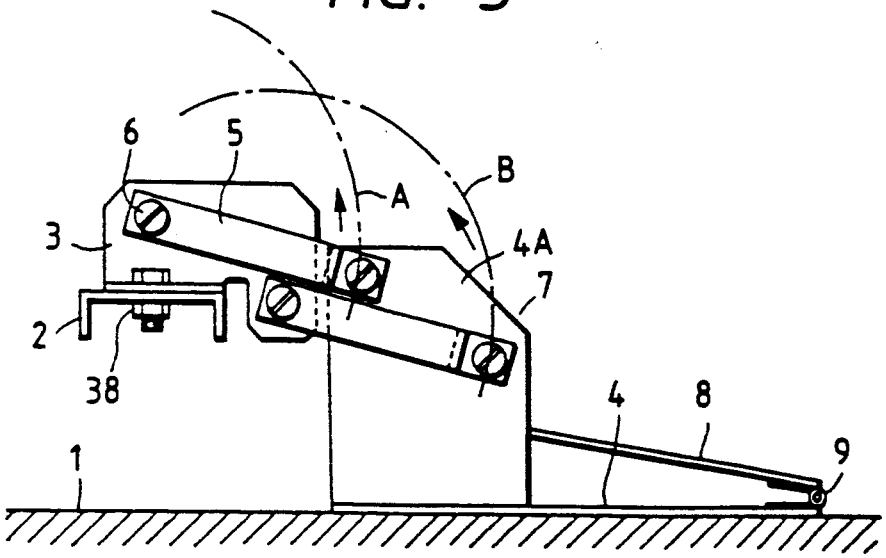
FIG. 3 is a front-elevational view of the pedal mechanism.
Figure 4:
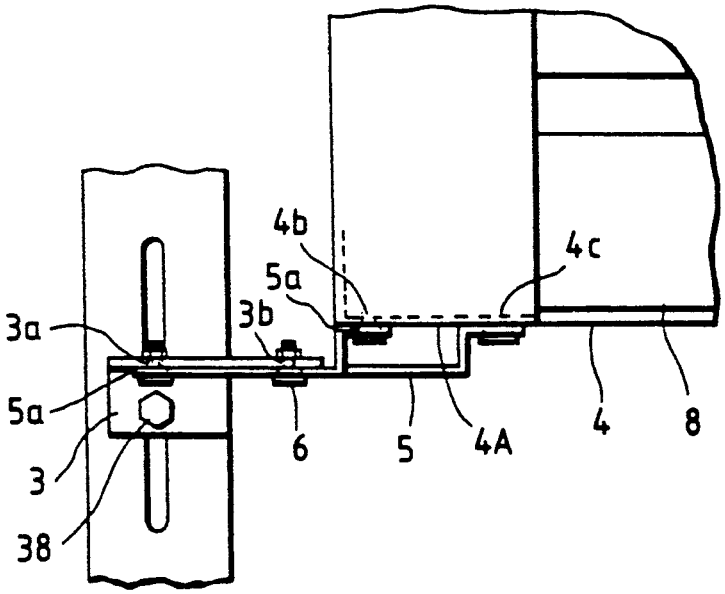
FIG. 4 is a plan view of the pedal mechanism.
Figure 5:
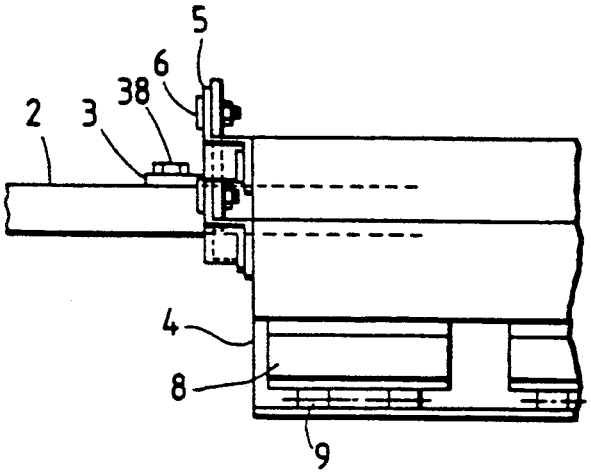
FIG. 5 is a side-elevational view of the pedal mechanism as viewed from the right side of FIG. 3.
Figure 6:
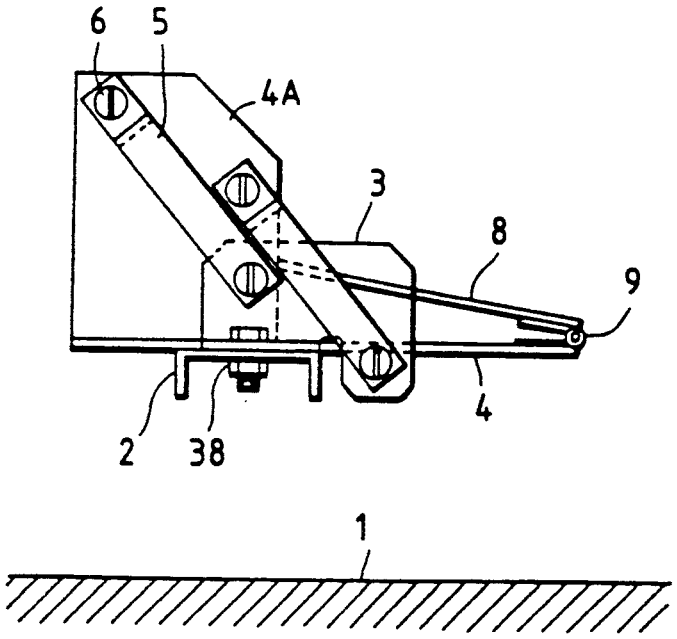
FIG. 6 is a view similar to FIG. 3, but showing the pedal mechanism in its retracted position.
Figure 7:
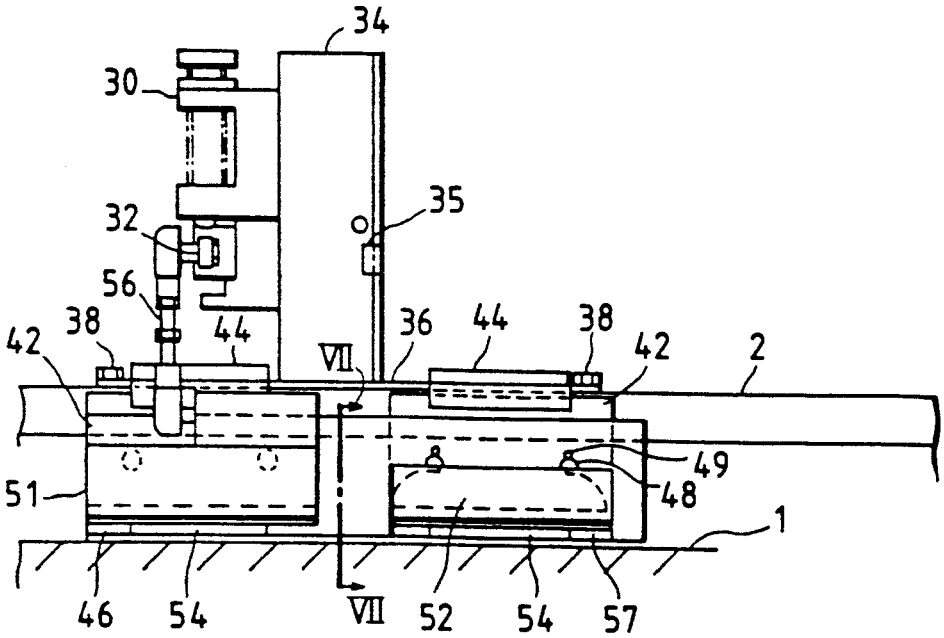
FIG. 7 PRIOR ART
FIG. 7 is a front-elevational view of a conventional pedal mechanism.
Figure 8:
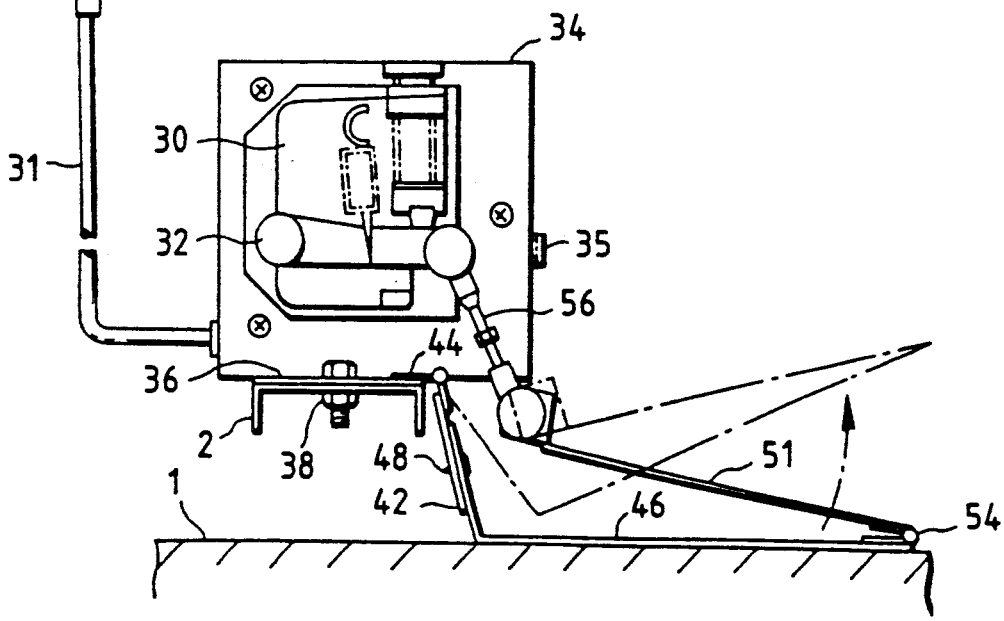
FIG. 8 PRIOR ART
FIG. 8 is a side-elevational view of the conventional pedal mechanism.
Figure 9:
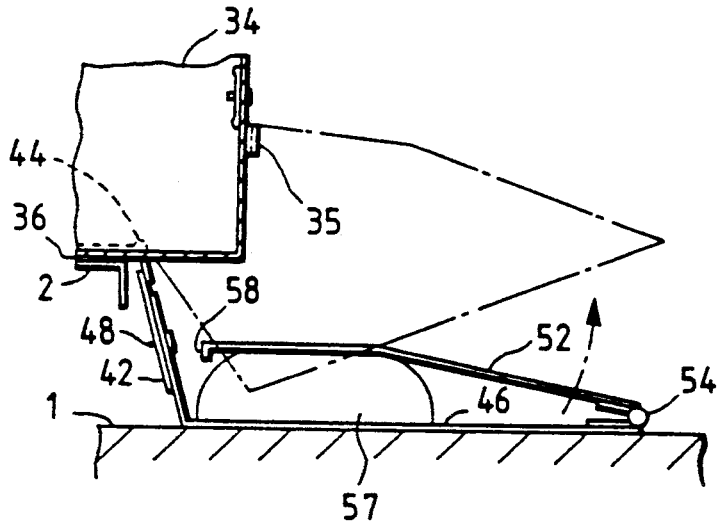
FIG. 9 PRIOR ART
FIG. 9 is a cross-sectional view of the conventional pedal mechanism.

When the sewing is not effected, the two pairs of connecting plates 5, disposed respectively on the opposite sides of the pedal mounting base 4, are angularly moved respectively about the axes of the connecting holes **3*a* and 3*b* of the support members 3, as indicated by dot-and-dash lines A and B in FIG. 3, while maintaining the pedal mounting base 4 in a horizontal condition. As a result, the pedal mounting base 4 is raised from the floor 1. At this time, when the connecting plates 5 are brought into a vertical condition, the pedal mounting base 4 is disposed at an uppermost position. Upon further angular movement of the connecting plates 5, the pedal mounting base 4 is placed on the support plate 2 extending horizontally between the legs of the sewing machine table, as shown in FIG. 6. When the sewing operation is to be carried out, the connecting plates 5 are angularly moved in a direction reverse to the above-mentioned direction, so that the pedal mounting base 4 is again placed on the floor 1, as shown in FIG. 3**.

Figure 2:
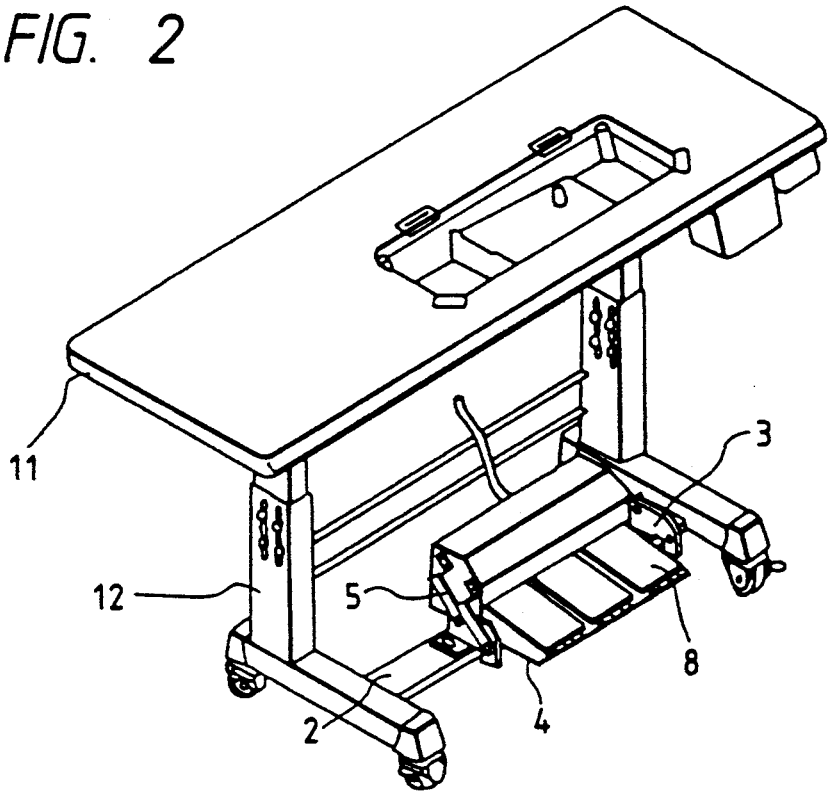

As described above, by virtue of the provision of the above linkage mechanism, the pedal mounting base 4 can be easily moved between an operative condition (FIGS. 1 and 3) and an inoperative or retracted condition (FIGS. 2 and 6). Further, the pedal mounting base 4 is passed past the uppermost position and is positively placed on the support plate 2 disposed at a level below the uppermost position, and therefore the pedal mounting base 4 can be held in its retracted position in a stable manner. Therefore, even if the sewing machine table is handled rather roughly when moving it, the pedal mounting base 4 will not drop and hence be free from damage.

When the pedal mounting base 4 is moved upward and downward, the sensor unit 7 of a delicate nature can be kept in a horizontal condition, and also the sensor unit can be held in such a retracted position that it can be easily viewed. Therefore, a malfunction will not be encountered, thus providing a reliable construction.

In the above embodiment, although the connecting plates 5 are used, any other suitable means such for example as a linkage mechanism can be used so long as the pedal mounting base 4 can be moved in parallel relation to the floor 1. Also, although each pair of connecting plates 5 of the same size are arranged in parallel relation, they may be replaced by longer and shorter connecting plates arranged in overlapping relation.

Further, in the above embodiment, although the two connecting plates 5 are provided on each side of the pedal mounting base 4, the number of these plates are not restricted to two. Further, although the pedal mounting base 4 has two connecting holes 4*b* and 4*c* on each side thereof, more than two such holes can be provided.

As described above, in the present invention, the pedal mounting base 4 is connected to the support member 3 by the connecting means so that the base can be moved in parallel relation to the floor 1. With this construction, the pedal mounting base 4 can be moved upward and downward in a horizontal condition, without being angularly moved or inclined. Further, since the pedal mounting base 4 can be held on the upper surface of the support plate 2, the installation of the sewing machine table can be easily done for effecting the sewing operation, and when the sewing machine table is to be moved in a non-sewing condition, the pedal mounting base can be easily raised with one touch in a stable manner, thus enhance the reliability of the pedal mechanism for the sewing machine drive device.

What is claimed is:

1. A pedal mechanism for a sewing machine drive device, comprising:

(a) a support member fixedly mounted on a support plate extending horizontally between legs of a sewing machine table;

(b) a pedal mounting base mounted adjacent to said support plate, a foot-operated pedal being mounted on said pedal mounting base, said pedal transmitting an operation signal to a sewing machine controller when said pedal is pressed down; and (c) a pair of connecting members for connecting said support member and said pedal mounting base, said connecting members being attached to sides of said pedal mounting base which are perpendicular to said support plate, so as to move said pedal mounting base upward and downward while maintaining said base in a horizontal condition, so that said pedal mounting base can be placed on said support plate.

2. A pedal mechanism according to claim 1, in which said pair of connecting members comprises a linkage mechanism.

3. A pedal mechanism according to claim 1, in which said pair of connecting members connects the sides of said pedal mounting base which are perpendicular to said support plate to said support member.

4. A pedal mechanism according to claim 1, in which when said pair of connecting members rotates said pedal mounting base counterclockwise, said pedal mounting base is moved from a lower position through an uppermost position continuing rotating counterclockwise and downward to a retracted position below said uppermost position, said pedal mounting base being placed on said support plate in said retracted position.

5. A pedal mechanism according to claim 1, in which said support member has at least first and second holes; said base has at least third and fourth holes; one of said connecting members connects said first hole in said support member to said third hole in said pedal mounting base, the other connecting plate connecting said second hole in said support member to said fourth hole in said pedal mounting base, in which said pair of connecting members can be angularly moved so as to move said pedal mounting base upward and downward while maintaining said pedal mounting base in a horizontal condition.

6. A pedal mechanism according to claim 5, in which when said pair of connecting members rotates said pedal mounting base counterclockwise, said pedal mounting base is moved from a lower position through an uppermost position continuing rotating counterclockwise and downward to a retracted position below said uppermost position, said pedal mounting base being placed on said support plate in said retracted position.

7. A pedal mechanism for a sewing machine drive device, comprising:

(a) a support member fixedly mounted on a support plate extending horizontally between legs of a sewing machine table; said support member having at least first and second holes;

(b) a pedal mounting base having a foot-operated pedal mounted thereon, said base having at least third and fourth holes; and (c) a pair of connecting plates one of which connects said first hole in said support member to said third hole in said pedal mounting base, the other connecting plate connecting said second hole in said support member to said fourth hole in said pedal mounting base, said connecting plates being connected to said support member and said pedal mounting base in such a manner that said connecting plates can be angularly moved so as to move said pedal mounting base upward and downward while maintaining said pedal mounting base in a horizontal condition.

8. A pedal mechanism according to claim 7, in which said pedal mounting base is angularly moved upward to be placed on said support plate at a higher position in a path of angular movement of said pedal mounting base.

9. A pedal mechanism for a sewing machine drive device, comprising:

(a) a pair of support members fixedly mounted on a support plate extending horizontally between legs of the sewing machine table, each of said support members having at least first and second holes;

(b) a pedal mounting base having sides perpendicular to said support plate, each of said sides having at least third and fourth holes located closest to a forward end portion of said pedal mounting base, said pair of support members being disposed respectively on each of said perpendicular sides of said pedal mounting base;

(c) a foot-operated pedal mounted on a rearward end portion of said pedal mounting base through a hinge, and being slanting upwardly toward said forward end portion of said base, said pedal transmitting an operation signal to a sewing machine controller when said pedal is pressed down; and (d) two pairs of connecting plates, one of said pairs of connecting plates connecting said support member to one said perpendicular side of said pedal mounting base and the other of said pairs of connecting plates connecting a second support member to a second said perpendicular side of said pedal mounting base, one of each pair of connecting plates connecting said first hole in said support member to said third hole in said pedal mounting base, the other connecting plate connecting said second hole in said support member to said fourth hole in said pedal mounting base, the distance between said first and third holes being equal to the distance between said second and fourth holes, said connecting plates being angularly movable respectively about the axes of said first and second holes in said support members so as to move said pedal mounting base upward and downward.

10. A pedal mechanism according to claim 9, in which said pedal mounting base is angularly moved upward to be placed on said support plate at a higher position in a path of angular movement of said pedal mounting base.

* * * * *